United States Patent [19]

Makrides et al.

[11] Patent Number: 4,608,318

[45] Date of Patent: Aug. 26, 1986

[54] CASTING HAVING WEAR RESISTANT COMPACTS AND METHOD OF MANUFACTURE

[75] Inventors: Nicholas Makrides, Delmont; Earle W. Stephenson, Latrobe, both of Pa.

[73] Assignee: Kennametal Inc., Latrobe, Pa.

[21] Appl. No.: 600,600

[22] Filed: Apr. 17, 1984

Related U.S. Application Data

[63] Continuation of Ser. No. 257,795, Apr. 27, 1981, abandoned.

[51] Int. Cl.[4] ..... B22F 7/08

[52] U.S. Cl. ..... 428/553; 428/558; 428/564; 75/240; 109/82

[58] Field of Search ..... 428/553, 562, 564, 563, 428/558, 911, 676, 677, 683, 685, 557; 164/97; 109/82; 75/246, 240; 89/36 A, 36.02

[56] References Cited

U.S. PATENT DOCUMENTS

| | | | |
|---|---|---|---|
| 2,349,052 | 5/1944 | Ollier | 75/136 |
| 2,372,607 | 3/1945 | Schwarzkopf | 89/36 A |
| 2,731,711 | 1/1956 | Lucas | 29/182.8 |
| 3,149,411 | 9/1964 | Smiley et al. | 29/187 |
| 3,258,817 | 7/1966 | Smiley | 22/202 |
| 3,566,741 | 3/1971 | Sliney | 89/36 A |
| 3,898,729 | 8/1975 | Greene | 428/563 |
| 4,119,459 | 10/1978 | Ekemar et al. | 75/243 |
| 4,173,457 | 11/1979 | Smith | 51/309 |
| 4,259,112 | 3/1981 | Dolowy, Jr. et al. | 428/549 |
| 4,327,156 | 4/1982 | Dillon et al. | 428/568 |

FOREIGN PATENT DOCUMENTS

| | | |
|---|---|---|
| 515636 | of 0000 | Australia . |
| 515427 | of 0000 | Australia . |
| 517117 | of 0000 | Australia . |
| 515905 | of 0000 | Australia . |
| 528527 | of 0000 | Australia . |
| 211272 | 3/1956 | Australia . |
| 449329 | 6/1971 | Australia . |
| 550740 | 5/1932 | Fed. Rep. of Germany . |
| 2722271 | of 0000 | Fed. Rep. of Germany . |
| 672257 | of 0000 | Fed. Rep. of Germany . |
| 2630932 | of 0000 | Fed. Rep. of Germany . |
| 2708308 | of 0000 | Fed. Rep. of Germany . |
| 2365747 | of 0000 | Fed. Rep. of Germany . |
| 2457449 | of 0000 | Fed. Rep. of Germany . |
| 1508887 | of 0000 | Fed. Rep. of Germany . |
| 1133089 | 7/1962 | Fed. Rep. of Germany . |
| 131280 | 3/1964 | New Zealand . |
| 131281 | 6/1964 | New Zealand . |
| 215453 | 9/1941 | Switzerland . |
| 2078575A | of 0000 | United Kingdom . |
| 530639 | 2/1941 | United Kingdom . |
| 861349 | 2/1958 | United Kingdom . |
| 820654 | 9/1959 | United Kingdom . |
| 1300864 | 12/1972 | United Kingdom . |
| 2007720A | 5/1979 | United Kingdom . |
| 1582574 | 1/1981 | United Kingdom . |

OTHER PUBLICATIONS

"Cemented Carbides", by Dr. Paul Schwarzkopf and Dr. Richard Kieffer, pp. 269–273.

Vol. II of Progress In Metallurgy (5 pages) Friedrich Eisenkolb, 1963.

*Primary Examiner*—Melvyn J. Andrews

*Assistant Examiner*—John J. Zimmerman

*Attorney, Agent, or Firm*—Lawrence R. Burns

[57] ABSTRACT

This invention relates to a double composite structure comprising cemented carbides embedded in an austenitic stainless steel matrix forming a wear, impact, drill and corrosion resistant shape by powder metallurgy techniques. Molten metal is then cast around the composite structure forming the body of a tool, lock or parts which are particularly useful for earthmoving and security applications.

18 Claims, 4 Drawing Figures

CASTING HAVING WEAR RESISTANT COMPACTS AND METHOD OF MANUFACTURE

This is a continuation of application Ser. No. 257,795, filed Apr. 27, 1981 now abandoned.

BACKGROUND OF THE INVENTION

The present invention relates to the field of wear resistant castings and their manufacture. More specifically, the present invention relates to the field of wear resistant earthworking castings and penetration resistant security devices.

In the field of earthworking equipment, the useful lifetime of the teeth contacting the formation being worked is important to the economic success of the work being performed.

The lifetime of these teeth are affected by the environment in which they operate. Typically, the environments encountered may produce conditions of abrasive wear, impact loading, temperature variation, vibration and corrosion at the teeth surface, all factors which tend to reduce the lifetime of the tooth or tool. The high cost in terms of downtime and tool cost for the replacing of worn out and broken tools has led to the development of a wide variety of tools designed to provide improvements in their in-service lifetimes.

In some cases, these improved tool designs have included the embedding of carbide into the tool working surface through casting processes (see, for example, U.S. Pat. Nos. 4,024,902 and 4,140,170).

These casting techniques present problems when it is desired to produce castings having relatively thin cross sections or when it is desired to place carbide particles on the surface of a vertically extending appendage, as well as a horizontal portion, of a casting.

In order to minimize dissolution of the carbide particles during casting, and the resulting brittle eta phase ($M_6C$ or $M_{12}C$ carbide containing tungsten and iron) produced at the carbide-steel interfaces, the cemented carbide particles utilized typically should have a size of at least 1/8 inch. Increasing the size of the particles reduces the carbide-steel interface area. However, in thin sections of a casting having a thickness only slightly larger than the carbide size, the carbides can act in conjunction with the mold to rapidly and excessively chill the molten metal flowing between the carbides and thereby cause incomplete filling in these thin sections.

It is also impractical to hold large cemented carbide particles uniformly dispersed along a vertical section of a casting without filling that section with carbide from the bottom up so as to hold the carbides in position during casting. This can lead to the aforementioned voids and/or incomplete filling due to excessive chilling of the melt.

Australian Patent No. AU-B1-31362/77 attempts to avoid the aforementioned casting problems by milling a heat treatable low alloy steel powder together with a tungsten carbide powder or tungsten molybdenum solid solution carbide powder, and then pressing and sintering to substantially full density a compact of the resulting mixture. Low alloy steel is then cast around the sintered steel-carbide compact to form a finished component. This Australian patent, however, limits the steel powders used to low chromium content steel.

BRIEF SUMMARY OF THE INVENTION

According to the present invention, a tough wear resistant body having carbide particles with a size greater than 400 mesh embedded substantially within a first metallic matrix are described. The above composite of carbide particles and first metallic matrix is bonded to a second metallic matrix. Preferably, the carbide particles are cemented carbide particles, most preferably containing tungsten carbide. Preferably, the carbide particles comprise 30 to 80 w/o of the composite and have a size greater than 40 mesh.

Preferably, the second metallic matrix substantially surrounds the composite of carbide particles and first metallic matrix.

Preferably, the first metallic matrix is composed of steel, preferably, stainless steel, and most preferably an austenitic stainless steel.

Preferably, the second metallic matrix is composed of steel, preferably, a low alloy steel or austenitic steel, and most preferably an austenitic stainless steel.

It is also preferred that the cemented carbide particles utilized contain principally tungsten carbide and a binder selected from cobalt, nickel, their alloys with each other, or their alloys with other metals.

It has also been found that where the first metallic matrix is austenitic stainless steel, the first matrix may be less than 90 percent dense or as low as 75 to 85 percent dense.

Also provided, according to the present invention, is a process in which the carbide particles are blended with the first metallic matrix powders, and the blend is then isostatically compacted and sintered. A second metallic matrix or molten metal is then bonded to said compact. The molten metal may be cast substantially around the compact or, depending on the application, such as in providing a wear surface, the molten metal may not completely incorporate the composite.

It is, therefore, an object of the present invention to minimize the brittle phases produced when casting molten metal around carbides.

It is, therefore, also an object of the present invention to provide a product having excellent wear, corrosion and drill resistant properties as well as good toughness.

Another object of the present invention is to provide a process by which an earthworking tool or penetration resistant security device can be fabricated.

BRIEF DESCRIPTION OF THE DRAWINGS

The exact nature of the present invention will become more clearly apparent upon reference to the following detailed specification, reviewed in conjunction with the following drawings.

DETAILED DESCRIPTION OF THE INVENTION

Figure 1:
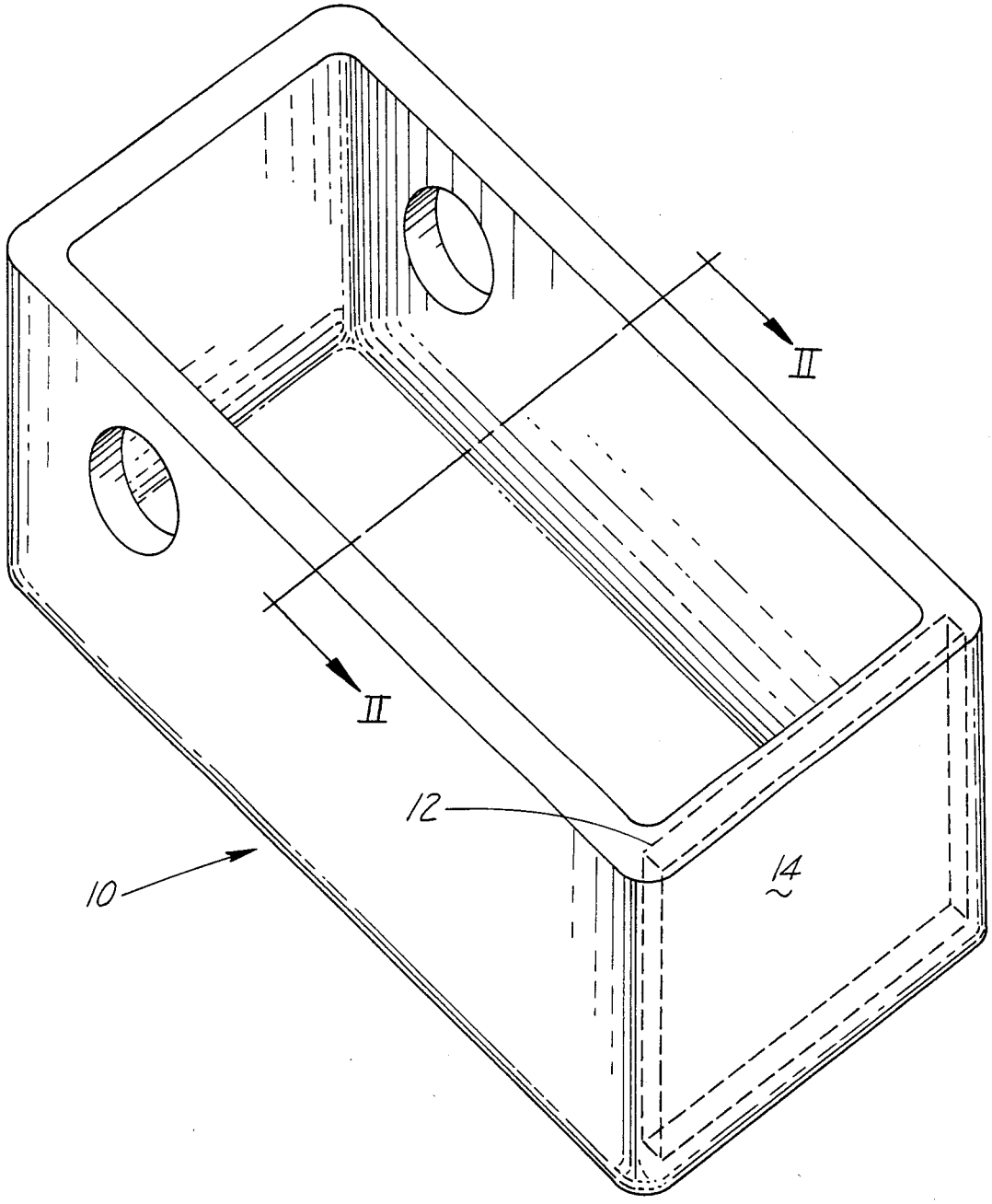
FIG. 1 shows an isometric view of a cast lock box according to the present invention.

In accordance with the present invention, 30 to 80 weight percent of carbide particles are blended with 70 to 20 weight percent of steel powder to produce a substantially uniform mixture of carbide and steel. The carbide particles used are preferably cemented tungsten carbides having a size of 400 mesh or, more preferably, greater than 40 mesh. Most preferably, these cemented carbide particles should have a size of −6+12 mesh (U.S. Sieve Series), or 0.13 between 0.066 inches, respectively.

It has been found that sintered composites containing cemented carbide particles within this most preferred size range are resistant to penetration by drilling.

Further improvements in wear resistance and drill penetration resistance may be obtained by utilizing carbide particles having a bimodal size distribution. In this embodiment of the invention, the size of the smaller carbide particles is selected so as to allow them to fit into the interstices formed between the larger carbide particles, thereby further increasing wear resistance.

The cemented carbide may have a metallic binder selected from cobalt, nickel, or cobalt-nickel alloys. In addition to the tungsten carbide, the cemented carbide may contain lesser amounts of other carbides, such as tantalum carbide, niobium carbide, hafnium carbide, zirconium carbide and vanadium carbide. Crushed and screened scrap cemented carbide has been found to be suitable for use in this process.

While tungsten carbide particles of greater than −400 mesh may be substituted for all or part of the cemented carbide particles in the composite, tungsten carbide powder is not preferred since it bonds less readily to the steel, tends to fracture easily and generally provides less wear and impact resistance than cemented tungsten carbides of the same particle size.

The steel powder utilized in this invention may be an alloy steel, but is preferably a stainless steel because of their greater resistance to corrosion. However, most preferred of the stainless steels are the austenitic stainless steels because of their high wear and impact resistance from room temperature down to cryogenic temperatures. Of the austenitic stainless steels, AISI types 301, 302, 304 and 304L grades are preferred because of their high work hardening rates.

In addition to the carbide and steel powders in the charge, organic binders are also added to prevent segregation and produce uniform distribution of the carbides during blending and retention of the uniform mixture after blending.

After bending, the mixture of powders is compacted by uniaxially pressing in a die or isostatic pressing in a preform mold, preferably at approximately 35,000 psi, but not less than 10,000 psi.

After compaction, the compact is then solid-state sintered at a temperature preferably below the melting point of the steel and, most preferably, in the range of 1900 degrees Fahrenheit to 2250 degrees Fahrenheit for 20 to 90 minutes, thereby avoiding the formation of eta phases at the cemented carbide-steel interface, and still providing a strong metallurgical bond between the cemented carbide and the steel. This bonding being formed by solid-state diffusion bonding.

In most cases, the bond between the steel and cemented carbide takes the form of an alloy layer at the cemented carbide-steel interface. This layer is principally comprised of cobalt and iron and is typically less than 40 microns thick. This bond is important to the secure retention of the coarse cemented carbide particles within the steel matrix.

It has been found that the as sintered compacts utilizing austenitic stainless steel powder generally exhibit interconnected microporosity and have a steel binder density of less than 90 percent of theoretical and, more typically, 75 percent to 85 percent of theoretical. To increase the density of the compacts' hot isostatic pressing infiltration or increased compacting pressures may be employed. These processes will also result in improved carbide retention in the composite. The infiltrant used may be selected from any of the copper base or silver base brazing materials that wet both stainless steel and carbide.

The sintered compact is then positioned within a mold and molten metal is poured around it to produce a casting. The casting procedure used may be any of those well known to those skilled in the art. However, it is preferred that the casting procedure described in U.S. Pat. No. 4,024,902 be used. Preheating of the compact may be utilized prior to pouring of the molten metal into the mold.

The molten metal may be a ferrous or non-ferrous alloy and is, preferably, steel. The type of steel utilizing need not be identical to that contained in the compact. Where impact, strength and corrosion properties are important, the cast steel is preferably an austenitic stainless steel. Low alloy and austenitic manganese steels may also be utilized.

The cast steel forms a metallurgical bond with the steel binder in the compact with a minimal amount of reaction with the cemented carbides. The formation of eta phase is thereby minimized since the surface area of the carbides coming into contact with the molten steel has been minimized.

The use of the cemented carbide-steel compacts also allows the carbides to be bonded in a variety of concentrations, positions and orientations both on the surface and beneath the surface of castings.

The process and products according to the present invention will become more apparent upon reviewing the following detailed examples.

EXAMPLE NO. 1

Figure 4:
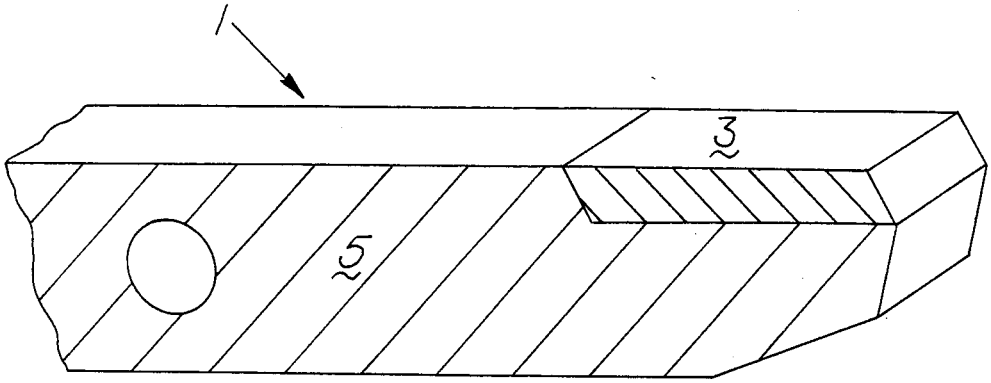
FIG. 4 shows a cross section through an embodiment of a digger tooth according to the present invention.

A number of wear and impact resistant digger teeth 1 (see FIG. 4) having compacts 3 were fabricated. A uniformly blended mixture composed of 60 w/o $\frac{1}{8}$ inch to 3/16 inch cobalt cemented tungsten carbide granules and 40 w.p minus 100 mesh atomized 304L austenitic stainless steel powder (manufactured by Hoeganaes Corporation of New Jersey) was prepared by dry mixing with 1.25 w/o paraffin and w/o 0.75 ethyl cellulose. The mixture was manually compacted into an elastomeric polyurethane mold cavity of the desired compact shape (2 inches long$\times\frac{3}{4}$ inch wide$\times\frac{1}{4}$ inch thick), dimensioned to allow for cold isostatic powder compaction plus one percent sintering shrinkage. Following cold isostatic compaction at 35,000 psi, the compacted preform was removed from the mold and vacuum sintered at 2100 degrees Fahrenheit for 60 minutes. The sintered bodies were then placed in a sand mold that had eight recesses formed to the required digger tooth shape. The ingredients to produce an AISI 4340 low alloy steel were melted in an induction furnace, the compacts were preheated, and the steel cast into the mold at 3050 degrees Fahrenheit to 3150 degrees Fahrenheit to form the digger tooth shown in FIG. 4 in which the 4340 steel 5 is bonded to two angularly related faces of the compact 3.

A metallographic examination disclosed that the stainless steel matrix containing an austenitic structure with some intergranular chromium carbides referred to as sensitization, which is typical of slow cooled austenitic stainless steels after sintering. Sensitization can be eliminated by a subsequent solution heat treatment. The cemented carbide-stainless steel matrix interfaces contained a continuous bond zone approximately 15 microns thick of an alloy principally composed of iron and cobalt. The cemented carbide dispersed particles appeared free of thermal cracking with a minimum amount of dissolution, melting or degradation of the dispersed carbide phase at or near the interfacial boundaries. There was some melting or blending of the stainless steel and some degradation of carbides where the molten metal made contact with the carbides at the surface of the compact. However, below the compact surface, the interfacial carbide boundaries were generally sharp except for the aforementioned iron-cobalt alloy diffusion zone. No potentially harmful concentrations of eta phases were observed.

Test samples were repeatedly (five and six times) struck with a ball peen hammer at room and at liquid nitrogen (−320 degrees Fahrenheit) temperatures and found to have good impact resistance with little evidence of brittle type fractures. It should be noted, however, that with a higher weight percent of cemented carbides in the composite, the impact resistance might be reduced sightly, but its resistance to wear and drill penetration would increase.

Micro hardness measurements of a section of the as cast digger tooth showed average hardnesses (indentations) of about 75 R"C", 29 R"C" and 38 R"C" within a traverse of the cemented carbide, 304L stainless steel and 4340 steel (0.125 inch from the stainless steel interfaces) respectively.

EXAMPLE NO. 2

A drill resistant lock box 10 shown in FIG. 1 was produced by casting molten 4340 grade low alloy steel around sintered 304L stainless steel-carbide plates (4 inches long×2½ inches wide×⅛ inch to 3/16 inch thick) and plates (3¼ inches long×2½ inches wide×⅛ inch to 3/16 inch thick). The position of one of the sintered plates 12 is shown by the dashed lines. The plates were made by uniformly blending a mixture of 50.0 w/o −8+12 mesh cobalt cemented tungsten carbide chips, 50.0 w/o −100 mesh AISI 304L stainless steel powder, and 10.0 w/o of binders (Chloruthene Nu and 0.75 Ethyl Cellulose).

The matrix stainless steel powder containing the dispersed hard carbide phase was packed in a polyurethane mold shaped to the plate dimensions. The mold was then sealed, placed in a rubber bag which was evacuated and sealed and then isostatically pressed at 35,000 psi. The compacted plate, after being removed from the rubber bag and mold, was sintered in a vacuum furnace at 2100 degrees Fahrenheit for 60 minutes.

Figure 3:
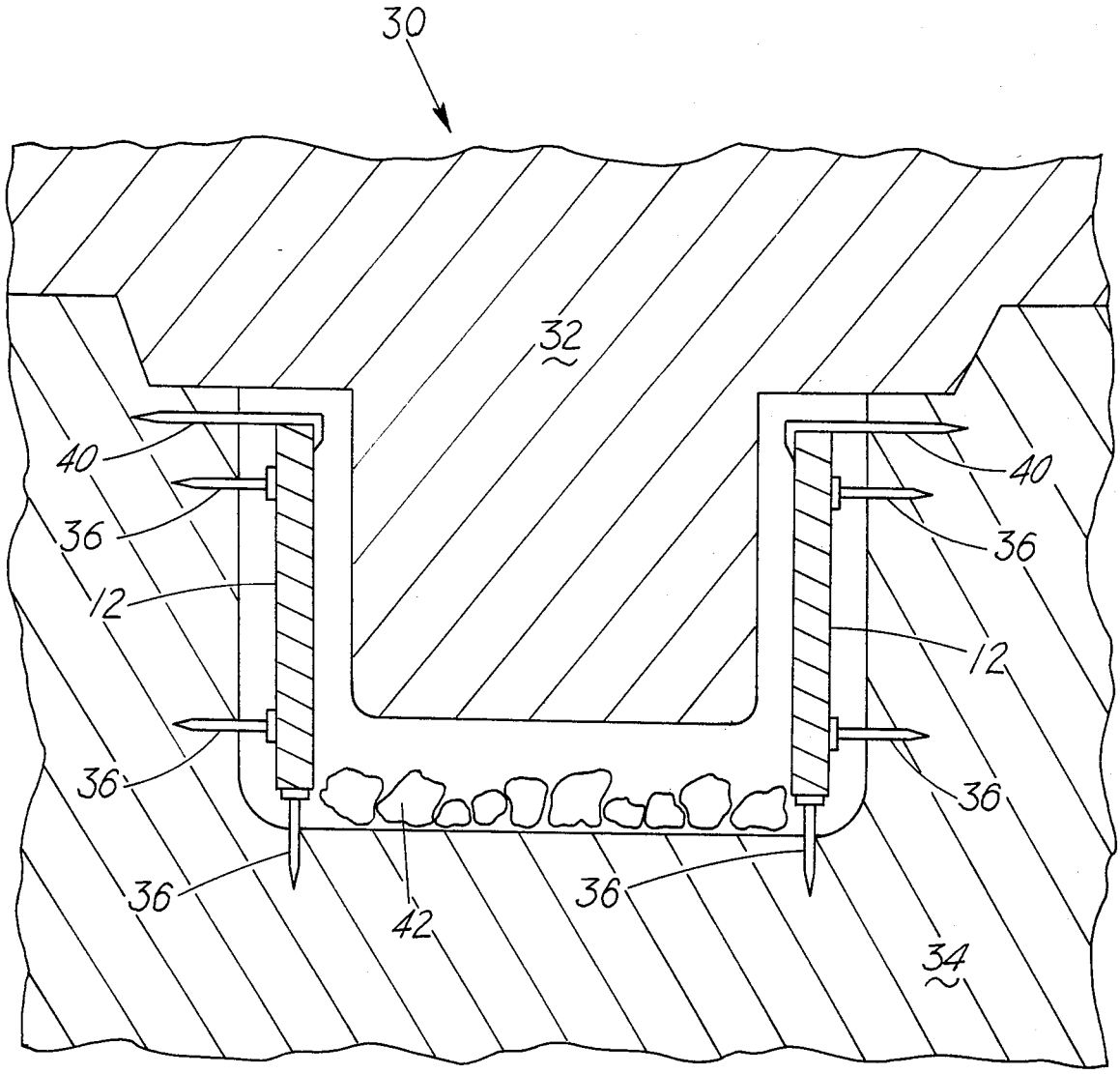
FIG. 3 shows a cross section through a mold cavity used to produce the FIG. 1 embodiment of the present invention.

The drill resistant plates were then positioned in the front, back and sides of the lock box cavity in a mold. FIG. 3 shows a section through a sand mold 30 having a cavity formed between a cope section 32 and a drag section 34. Sintered plates 12 are shown held in position in the side wall cavities by nails 36 and 40 which are embedded in the drag portion 34 of the mold 30. Cemented carbide particles 42 have been laid on the bottom surface of the cavity. Prior to placing the cope 32 on to the drag 34, the cemented carbide particles 42 and plates 12 were preheated. The cope 32 was then placed into the drag 34 and molten 4340 low alloy steel was poured into the mold cavity.

The objective of the present invention in this security application is to provide the lock box with ⅛ inch thick sintered stainless steel-cemented carbide plates enveloped with steel for protection against drill penetration.

It is a further objective and novel feature of this invention that when making the lock box that the plate or plates will retain their shape and the carbide particles remain uniformly dispersed in the plates when molten steel is cast around them filling the remaining lock box wall cavity. After the destruction of two masonary ⅛ diameter drill bits, the front section 14 of the lock box 10 shown in FIG. 1 was not penetrated.

Figure 2:
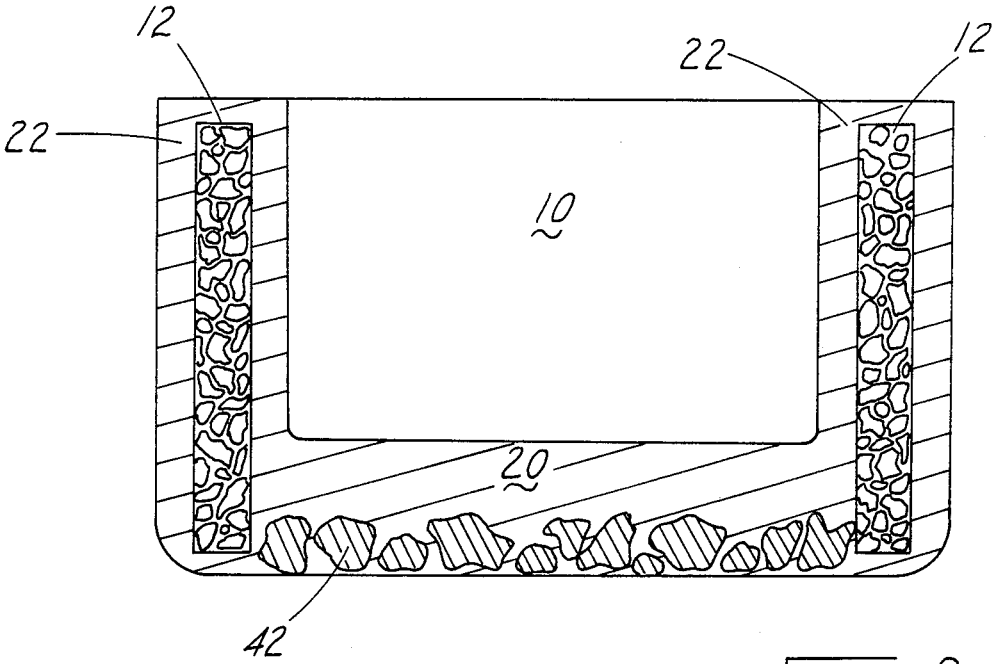
FIG. 2 shows a cross section of the embodiment shown in FIG. 1 viewed along arrows II—II.

A section cut through the lock box containing the carbide-stainless steel plate is shown in FIG. 2. There was a little melting of the stainless steel when the molten alloy steel was cast around the sintered stainless steel carbide plate and the carbides remained uniformly dispersed in the plate 12. There was very little carbide degradation and a minimum of brittle phases at the carbide-4340 steel interfaces. A metallurgical bond was produced between the austenitic structure of the stainless steel and the 4340 cast steel structure. The carbide particles 42 in the bottom wall 20 of the box may be replaced by plates identical or similar to those shown in the side walls 22.

EXAMPLE NO. 3

Drill and impact resistant, 5/32 inch thick plates were fabricated. Fifteen plates consisted of a uniformly blended mixture of 60 w/o 3/32 inch to ⅛ inch (−8+12 mesh) cobalt cemented tungsten carbide chips, 40 w/o minus 100 mesh 304L stainless steel powder, 2 w/o of chlorothene Nu, 1 w/o ethyl cellulose and ¼ w/o armido wax. A second group of 15 plates were made with 70 w/o (−8+12 mesh) cemented carbide chips and 30 w/o (−100 mesh) 304L stainless steel powder similarly blended. The armido wax and ethyl cellulose were added to the powder blend during mixing as a pressing lubricant to prevent segregation of the carbide particles during mixing and mold filling. Next, the matrix powder containing the dispersed hard carbide phase was packed in a preform mold made of polyurethane. The packed mold with a suitable fitted cover was then sealed and placed in a rubber bag or balloon which was evacuated, sealed and isostatically pressed at about 35,000 psi. The plates were then sintered in a vacuum furnace at 2100 degrees Fahrenheit for 60 minutes.

These plates may now be incorporated into a casting using the casting techniques previously described or any of the other casting methods known in the art.

Modifications may be made within the scope of the appended claims.

What is claimed is:

1. A tough wear resistant body comprising: a penetration resistant component formed by powder metallurgy methods of compaction and solid state diffusion bonding at temperatures between about 1900° F. and about 2250° F. and having cemented tungsten carbide particles with a size greater than 400 mesh, a stainless steel matrix, and wherein said particles are bonded to and located substantially within said stainless steel matrix; a second metallic matrix; and wherein said penetration resistant component is bonded to and embedded in said second metallic matrix.

2. A tough wear resistant body according to claim 1 wherein said second metallic matrix substantially surrounds said penetration resistant component.

3. A tough wear resistant body according to claim 1 wherein said stainless steel matrix comprises an austenitic stainless steel.

4. A tough wear resistant body according to claim 3 wherein said second metallic matrix comprises steel.

5. A tough wear resistant body according to claim 1 wherein said cemented carbide particles have a size greater than 40 mesh.

6. A tough wear resistant body according to claim 5 wherein said cemented carbide particles further comprise a binder selected from the group consisting of cobalt, nickel, their alloys with each other, and their alloys with other metals.

7. A tough wear resistant body according to claim 3 wherein said matrix of austenitic stainless steel is less than 90 percent dense.

8. A tough wear resistant body according to claim 7 wherein said matrix is 75 to 85 percent dense.

9. A tough wear resistant body according to claim 1 wherein said cemented carbide particles have an irregular shape.

10. A tough wear resistant body according to claim 1 wherein said carbide particles have a bimodal size distribution.

11. A tough wear resistant product prepared by a process comprising the steps of: compacting a mixture of cemented tungsten carbide particles with a size greater than 400 mesh and a stainless steel powder; solid state sintering said compact at a temperature of 1900 to 2250 degrees Fahrenheit and bonding a molten metal to said compact.

12. The product prepared by the process according to claim 11 wherein said cemented carbide particles comprise 30 to 80 w/o of said compact.

13. The product prepared by the process according to claim 11 wherein said compacting step comprises isostatic compacting.

14. The product prepared by the process according to claim 11 further comprising the step of selecting cemented carbide particles having a mesh size greater than 40 mesh to be used in said mixture.

15. A metallic casting comprising: a base portion; a wall portion; said wall portion extending out of the plane of said base portion; a sintered compact of cemented carbide particles and stainless steel powder formed by solid state sintering at a temperature within the temperature range of between about 1900° F. and about 2250° F.; said compact bonded to and substantially contained within said wall portion.

16. A metallic casting according to claim 15 wherein said wall has a first predetermined thickness; said compact has a second predetermined thickness; and said first predetermined thickness is greater than said second predetermined thickness.

17. A metallic casting according to claim 15 wherein said cemented carbide particles are substantially uniformly distributed through said compact.

18. A metallic casting according to claim 15 wherein said cemented carbide particles have a size greater than 400 mesh.

* * * * *